US005165698A

United States Patent [19]

Vanderhye

[11] Patent Number: 5,165,698

[45] Date of Patent: Nov. 24, 1992

[54] REFLEX DEVELOPING KIT AND PROCEDURE

[76] Inventor: Keith G. Vanderhye, 801 Ridge Dr., McLean, Va. 22101

[21] Appl. No.: 607,101

[22] Filed: Oct. 31, 1990

[51] Int. Cl.[5] ..... A63B 67/10

[52] U.S. Cl. ..... 273/445; 273/359

[58] Field of Search ..... 273/445, 317, 343, 351, 273/359, 378, 26 EA

[56] References Cited

U.S. PATENT DOCUMENTS

| | | | |
|---|---|---|---|
| 1,907,412 | 5/1933 | Zimmer | 273/26 EA |
| 2,101,276 | 12/1937 | Walter | 273/351 X |
| 2,680,022 | 6/1954 | Walden | 273/26 EA |
| 3,086,775 | 4/1963 | Albert | 273/26 EA |
| 3,550,937 | 12/1970 | Wright | 273/26 EA |
| 4,080,750 | 3/1978 | Palumbo | 273/351 X |
| 4,177,991 | 12/1979 | Meyer et al. | 273/317 |
| 4,664,389 | 5/1987 | Barclay et al. | 273/343 |
| 4,915,394 | 4/1990 | Kramer | 273/343 X |

*Primary Examiner*—William H. Grieb

[57] ABSTRACT

A kit and method are provided for developing one's reflexes, which also may be used as a toy or game. The kit includes a strand, such as a nylon string, having a length greater than six feet and a given outside diameter, and at least one—and preferably a number of—tubular shuttles having a length of less than about a foot and having an inside diameter slightly greater than the outside diameter of the strand. A blinder, such as an eye patch or a batting helmet for restricting a user's peripheral vision, is provided too. Hooks or clasps may be provided at the ends of the strands to facilitate attachment, and a turnbuckle can be utilized to adjust the tension of the strand. The shuttles may be plastic tubes that are slit along their length for easy attachment or detachment, and may have streamers attached to them. In use, one end of the strand is attached higher than the second end or a central portion of the strand, and the shuttle is slid upwardly on the strand. The user faces the strand, and as the shuttle approaches moves his/her hand toward the strand to grasp the shuttle. The blinder prevents the user from seeing the shuttle until it is almost at the user's position. When used as a game, a second player slides the shuttle down the strand, trying to get it past the first player.

20 Claims, 1 Drawing Sheet

REFLEX DEVELOPING KIT AND PROCEDURE

BACKGROUND AND SUMMARY OF THE INVENTION

For many athletic endeavors, as well as for safety in operating a wide variety of equipment, it is desirable to have quick reflexes. This is especially true of activities also requiring good hand-eye coordination. According to the invention, a kit and a method are provided which allows one to develop his/her reflexes without the aid of another person. The kit is versatile, however, and may be utilized by two or more people to play a game, which game inherently develops one's reflexes. Small children are also capable of utilizing the kit apparatus, and a child would certainly consider the kit apparatus as a toy.

The basic elements needed to practice the method, or play the game, according to the present invention are simply a strand having first and second ends, and at least one tubular shuttle having an inside diameter somewhat greater than the outside diameter of the strand, and being open at both ends. The strand may be a nylon string, cable, rope, or any other suitable element over six feet long. A first end of the strand is connected to a high point, such as an eyelet in the top of the wall, a bannister on the second story of an open stairwell, or the like, so that it is above another portion of the strand (such as a central portion thereof or the second end of the strand). A tubular shuttle, having a length of less than about a foot, receives the strand and is easily slidable over the strand.

When used as a reflex developing device, or toy, the user stands facing the strand (e.g. a plane bisecting the user's eyes extending generally perpendicular to the strand) at a position of the strand much lower than the first, elevated end thereof. The user then slides the shuttle upwardly toward the first end, against the force of gravity, while remaining stationary looking at the strand immediately in front of the user's position (i.e. not following the path of travel of the shuttle), and holding one's hand away from the strand. As soon as the strand comes into view, the user then reaches out his/her hand and attempts to grasp the shuttle before it passes the user's position. This is continuously repeated, and the user can use both his/her right and left hands at different times.

When played as a game, a second player will be positioned adjacent the first end of the strand—e.g. on a balcony to which the first end is tied. The second player will then slide the shuttle down the strand toward the position of the first player, trying to move the shuttle past the first player.

In order to be sure that the user does not "cheat" by following the path of movement of the shuttle rather than waiting for it to come into view, preferably a kit containing the strand and shuttle has a blinder means utilizable to fit on the user's face so as to restrict the user's peripheral vision out of at least one eye (that is the eye closest to the first end of the strand). In this way the user cannot see the shuttle until it is virtually right in front of him/her. The blinder may take the form of an eye patch or a batting helmet.

Preferably a plurality of tubular shuttles—in the form of plastic tubes—are provided, at least some of them being of different length than others, so that as the user's skill level develops he/she can use shorter and shorter tubular shuttles. Also, the shuttle may be made of a flexible plastic and slit along the length thereof so that it is easy to put it around or remove it from the strand. Further, if desired, streamers may be provided attached to the shuttle which—in a variation—the user must grab instead of the shuttle itself. The streamers may be different colors, and as part of the exercise or game the user/-player can only grab the streamer of a particular color.

To facilitate easy attachment of the strand a hook or a clasp may be provided at the ends thereof. To facilitate tensioning of the strand, a turnbuckle may also be provided, such as a turnbuckle having a hook at one end thereof, for easy attachment, and an apertured plate at the opposite end thereof to which an end of the strand can be lashed.

It is the primary object of the present invention to provide a kit and a method which allow one to develop one's reflexes in a fun and challenging manner. This and other objects of the invention will become clear from an inspection of the detailed description of the invention, and from the appended claims.

DETAILED DESCRIPTION OF THE DRAWINGS

Figure 1:
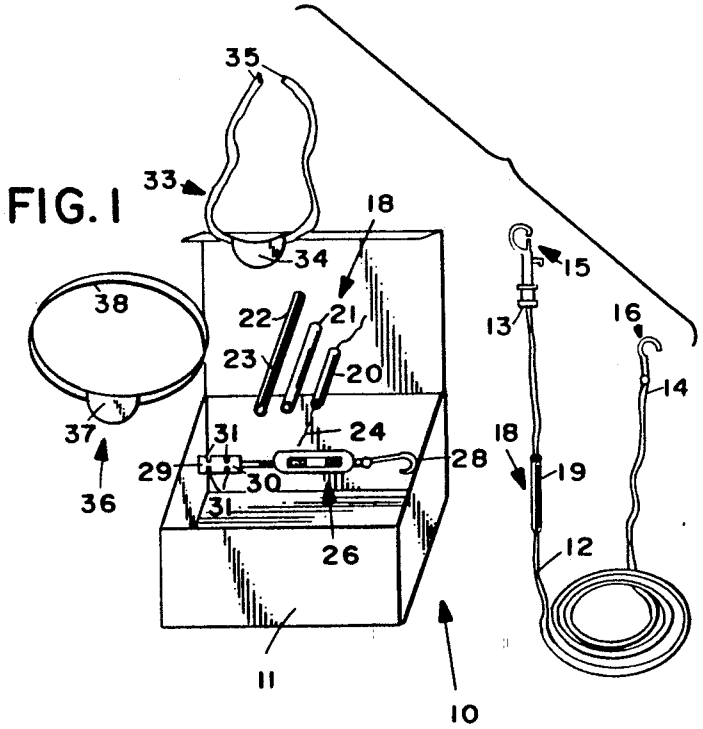
FIG. 1 is a perspective view of an exemplary kit according to the present invention.

An exemplary kit according to the present invention is shown generally by reference numeral 10 in FIG. 1. All of the components of the kit 10 are packaged in a container, such as a box 11, plastic bag, or held by shrink-wrap plastic onto a card. One of the main components of the kit is a strand 12 which is at least six feet long, and more typically is about 20–25 feet long, and has a first end 13 and a second end 14. In order to facilitate attachment of the ends 13 and 14 to objects during use of the components of the kit 10, a clasp 15 or a hook 16 (e.g. a rubber coated metal hook) may be provided, the strand ends 13, 14 being tied to eyelets at the ends of the clasp 15 or hook 16.

A second major component of the kit 10 according to the invention is at least one tubular shuttle 18, having a length of less than about a foot. Preferably a number of different shuttles are provided, as indicated by the shuttles 19, 20, 21, and 22 in FIG. 1. The tubes 19 through 22 preferably are plastic tubes that are open at both ends thereof. For example, the tubes could be of a rigid plastic, such as the body of the plastic pen, or may be of a very flexible plastic and may be easily bent out of a tubular configuration by grasping the surfaces leading to form the longitudinal slit 23, yet returning under the memory of the plastic to form a tubular configuration. The inside diameter of the shuttles 18 are slightly greater than the outside diameter of the strand 12. That is typically shuttles 18 would have an inside diameter of about 1½ to 5 times the outside diameter of the strand 12.

If desired, streamers 24 may also be associated with one or more of the shuttles 18. For example, the streamers 24 may extend from both ends of the open-ended tubular shuttle 20. The streamers 24 may be of different colors so as to provide a variation of the game or reflex developing device.

Sometimes it is desirable to be able to adjust the tension of the string after it has been connected for use or play. This is preferably accomplished by a turnbuckle 26. The turnbuckle 26 may be connected to one of the ends of the strand 12, or into a central portion thereof. Where connected to one of the ends of the strand, preferably a hook 28 or like attachment facilitating device is provided at one end thereof, while a strand attachment facilitating device 29 is provided at the other end thereof. The strand facilitating attachment device 29 may comprise a plate 30 with a plurality of notches 31 or like surface manifestations formed therein which allow the string to be wrapped into place on the plate 30 without requiring tying into a knot.

Figure 2:
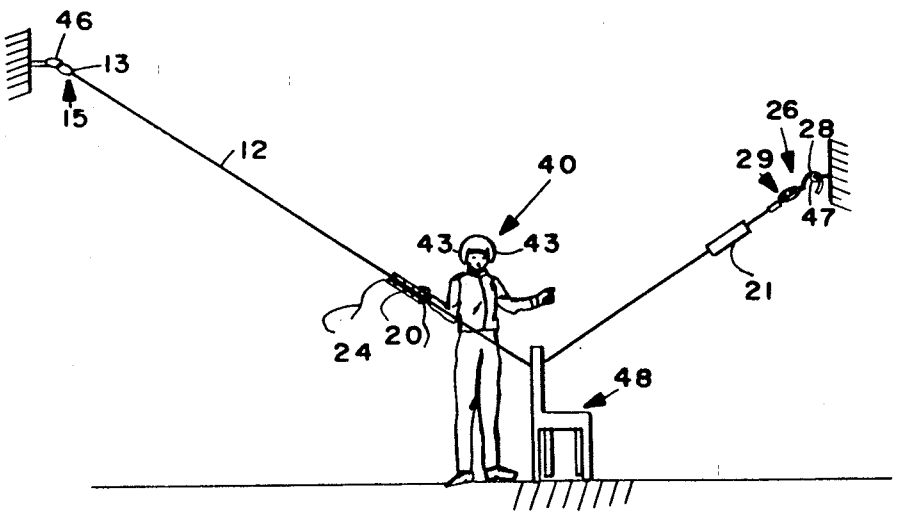
FIG. 2 is a schematic side view showing the use of the kit parts by one developing one's reflexes.
Figure 3:
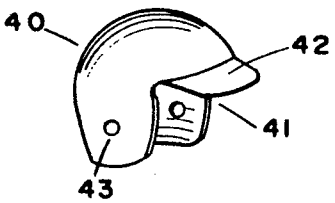
FIG. 3 is a perspective view of a batting helmet utilized by the person in FIG. 2.

The kit 10 also preferably comprises blinder means for a user of the kit, to fit on the user's face so as to restrict the user's peripheral vision out of at least one eye. This insures that the user cannot "cheat", i.e. so that his/her reflexes are properly tested. One form that the blinder means may take is the eye patch 33 having an eye patch body 34 adapted to cover one of the user's eyes, with the ties 35 connected to the patch body 34 that can be tied into a knot to hold the body 34 on the user's face. Alternatively, an eye patch 36 can be utilized having an eye patch body 37 which is connected to the user's head with an elastic loop 38. Still another form that the blinder means can take is illustrated in FIGS. 2 and 3. This alternative means is a conventional batting helmet 40 used by baseball players, having an open face portion 41, optionally having a trim 42, and having an ear piece 43 which will restrict peripheral vision. According to the invention, the conventional batting helmet 40 may be modified to "an ear piece" or like flange/blinder 43 on both sides of the open face 41.

FIG. 2 illustrates one exemplary use of the components of the kit 10 according to the present invention to develop one's reflexes. A first end 13 of the strand 12 is connected to a high point, such as the eyelet 46 adjacent the sealing in a room, as by utilizing the clasp 15. Then either a central portion of the strand 12, or the second end 14 thereof is connected well below the first end 13. At least one shuttle 18, such as the shuttle 20, is provided on the strand 12, slidable thereover.

The user stands adjacent a low point of the strand 12 and positions himself/herself facing the strand (e.g. so that a plane bisecting the user's eyes is perpendicular to the strand 12). Then the user grasps the shuttle with one hand (e.g. the right hand as illustrated in FIG. 2) and slides the shuttle 20 toward the first end 13 of the strand 12, that is upwardly against the force of gravity. The user continues to look straight forward rather than following the path of the shuttle 20. An eye patch 33, 36 or the flange/blinder 43 on the batting helmet 40 restricts the user's peripheral vision so that he/her cannot "cheat" and watch the path of the shuttle 20. The user holds his/her hand away from the strand 12, and as soon as he/she sees the shuttle 20, he/she reaches out his/her hand and attempts to grasp the shuttle 20. Alternatively, the user can attempt to grasp the streamers 24 (or one particular streamer of a particular color) rather than the body of the shuttle 20 itself.

If the user has grasped the shuttle 20, the user then, repeating the previous step, slides the shuttle 20 upwardly toward the first end 13 thereof, and again looking straight forward. If the user has missed the shuttle 20, the user retrieves it from the bottom termination of its path of travel, and slides it upwardly from that position.

When the strand 12 is positioned as illustrated in FIG. 2, with the second end thereof—attached by hook 28 of turnbuckle 26 to eyelet 47—also elevated with respect to a central portion of the strand 12, the user can position himself/herself to test the reflexes of both hands. For example, the user could move over a step or two to his/her left (as viewed in FIG. 2) to right next to the chair 48 which forms the bottom portion of the strand position (the central portion of the strand 12), sliding the shuttle 21—and then attempting to grasp it—with his/her left hand, while operating the shuttle 20 with his/her right hand. If the tension of the strand 12 is not sufficient to provide rapid or even sliding movement of the shuttles 20, 21, then the turnbuckle 26 is adjusted so that the tension is appropriate.

As an alternative for merely using the kit 10 components as a reflex developing device or toy, the components can also be used as a game. When used as a game, the first player who attempts to grasp the shuttle 18 is positioned adjacent a low point thereof, while a second player positions himself/herself adjacent the first, highest, end 13 of the strand 12 (e.g. on a balcony, or if the second player is tall enough merely by reaching upwardly). When the first player slides the shuttle 18 upwardly on the strand 12, the second player catches it and then either releases it, or applies a force sliding it downwardly, at his/her discretion and timing, trying to get the shuttle past the first player (that is so that the first player cannot grasp it). Whoever pushes the shuttle past the other player (or players) the most times compared to the number of times that the player grasps the shuttle or streamers himself/herself determines the winner.

It will thus be seen that according to the present invention a very desirable reflex developing kit of components, and method have been provided, which also may be utilized as a toy or game. While the invention has been herein shown and described in what is presently conceived to be the most practical and preferred embodiments thereof, it will be apparent to those of ordinary skill in the art that many modifications may be made thereof within the scope of the invention, which scope is to be accorded the broadest interpretation of the appended claims so as to encompass all equivalent apparatus and methods.

What is claimed is:

1. A kit for reflex developing and toy device, comprising:

a strand having a length greater than about six feet, and a given outside diameter, and first and second ends for attaching the strand to attachment objects;

at least one tubular shuttle having a length of less than about one foot and having an inside diameter slightly greater than the outside diameter of said strand, said shuttle open at both ends; and blinder means for a user of the kit to fit on the user's face so as to restrict the user's peripheral vision out of at least one eye.

2. A kit as recited in claim 1 wherein said at lest one tubular shuttle comprises a plurality of tubular shuttles, each having an inside diameter slightly greater than the outside diameter of said strand, and open at both ends, and each shuttle having a different length than another shuttle.

3. A kit as recited in claim 2 wherein said tubular shuttles are plastic tubes.

4. A kit as recited in claim 3 wherein at least one of said shuttles has streamers attached thereto.

5. A kit as recited in claim 3 wherein at least one of said tubes is slit along its length for easy attachment or detachment to or from said strand.

6. A kit as recited in claim 1 wherein a hook is provided at one end of said strand.

7. A kit as recited in claim 1, wherein a clasp is provided at one end of said strand.

8. A kit as recited in claim 1 wherein said blinder means comprises an eye patch.

9. A kit as recited in claim 1 further comprising a turnbuckle.

10. A kit as recited in claim 9 wherein said turnbuckle has a hook at one end thereof.

11. A kit as recited in claim 1 wherein said blinder means comprises a baseball batting helmet having two protective flanges/blinders, one on each side of an open front.

12. A kit as recited in claim 1 wherein said tubular shuttle is a plastic tube which has a plurality of different colored streamers attached thereto.

13. A method of developing one's reflexes, utilizing a tubular shuttle slidable along a strand having first and second ends, comprising the steps of:

(a) fixing the ends of the strands to objects that will stay in place during use, with the first strand end significantly higher than either the second end or a central portion of the strand, and with the tubular shuttle sliding over the strand, receiving the strand therein;

(b) at a position remote from the first strand end, sliding the shuttle toward the strand first end against the force of gravity;

(c) standing at a position facing the strand so that a plane bisecting one's eyes is generally perpendicular to the strand, and looking directly at the strand, remote from the strand first end, and while holding one's hand away from the strand;

(d) as the shuttle approaches the standing position, moving one's hand toward the strand to grasp the shuttle before it passes one's position; and (e) repeating steps (b)-(d).

14. A method as recited in claim 13 comprising the further step of replacing the shuttle with another shuttle of shorter length as one's skills improve.

15. A method as recited in claim 13 comprising the further step (f) of significantly reducing or eliminating the peripheral vision of one's eye closest to the strand first end.

16. A method as recited in claim 15 wherein step (f) is practiced by placing an eye patch over one's eye closest to the strand first end.

17. A method as recited in claim 15 wherein step (f) is practiced by wearing a batting helmet.

18. A method as recited in claim 13 further using a turnbuckle operatively connected to the strand to adjust the tension therein, and wherein step (a) is practiced by adjusting the tension of the strand by adjusting the turnbuckle.

19. A method as recited in claim 13 wherein step (a) is practiced so that both the first and second ends of the strand are higher than a central portion thereof, and wherein one stands adjacent the central portion, and wherein steps (b)-(d) are practiced with two different shuttles, sliding one toward each of the ends of the strand, and trying to grasp each shuttle with a different hand.

20. A reflex testing game method utilizing a strand having a first end higher than a second portion of the strand, and a tubular shuttle slidable over the strand, played by first and second players, the first player standing adjacent the first end of the strand, and the second player adjacent the second portion of the strand, comprising the steps of:

the first player slides the shuttle over the strand from the first end toward the second portion;

the second player looks right at the strand, rather than the approaching shuttle, and reaches out his hand to grasp the shuttle as it moves past him; and after grasping or retrieving the shuttle, the second player slides the shuttle up the strand back toward the first player.

* * * * *